US005097736A

United States Patent [19]

Turner

[11] Patent Number: 5,097,736

[45] Date of Patent: Mar. 24, 1992

[54] STRINGED INSTRUMENT TUNING DEVICE

[75] Inventor: William T. Turner, Santa Rosa, Calif.

[73] Assignee: LSR Company, Santa Rosa, Calif.

[21] Appl. No.: 563,465

[22] Filed: Aug. 7, 1990

[51] Int. Cl.[5] ..... G10D 3/14

[52] U.S. Cl. ..... 84/304; 24/71.1

[58] Field of Search ..... 84/200–208, 84/297 R, 304–306, 312 R, 312 P; 24/71.1; 403/347, 373

[56] References Cited

U.S. PATENT DOCUMENTS

| | | | |
|---|---|---|---|
| 4,213,370 | 7/1980 | Jones | 84/291 |
| 4,625,613 | 12/1986 | Steinberger | 84/298 |
| 4,625,614 | 12/1986 | Spercel | 84/306 |
| 4,643,069 | 2/1987 | Borisoff et al. | 84/306 |
| 4,648,303 | 3/1987 | Bradthen et al. | 84/306 |
| 4,674,387 | 6/1987 | Caruth | 84/304 |
| 5,018,424 | 5/1991 | Steinberger | 84/304 |

*Primary Examiner*—L. T. Hix
*Assistant Examiner*—Howard B. Blankenship
*Attorney, Agent, or Firm*—Skjerven, Morrill, MacPherson, Franklin & Friel

[57] ABSTRACT

A tuning device includes a tuner housing extending from a string instrument, such as a guitar, with an integral orthogonal threaded mounting portion mounted in a peg head aperture. A tuner rod extends concentrically through the tuner housing and has a distal end with a transverse interior passageway extending at the end of the housing. A loose clamping pin or screw extends concentrically in the tuning rod to the transverse passageway. After a string end is pushed through the passageway and drawn taut a lock knob or the hex-headed screw at the tuner rod opposite end is threaded into the tuner rod forcing a separate or integral clamping pin against the taut end of the string and to clamp the string in the transverse passageway. An internally threaded tuning knob adjacent to lock knob or hex-headed screw is rotatable on outer threads of the tuner rod at its proximal end to move the tuner rod longitudinally inward in the tuner housing pulling with it the clamped string. This action tensions the string to the proper desired pitch. Flattened portions on the tuning rod and tuner housing permits non-rotative longitudinally movement of the tuner rod. A guide disc on the tuner device adjacent the passageway guides the string into the passageway initially during the tuning. Spacers are provided under a flange on the mounting portion to assure that the strings exit at a proper angle to the guitar finger board.

20 Claims, 5 Drawing Sheets

STRINGED INSTRUMENT TUNING DEVICE

FIELD OF THE INVENTION

This invention relates to string instruments such as those of the guitar type. More particularly the invention is directed to a series of tuning devices for initially affixing one end of a music string to the instrument and for tuning that string and succeeding strings to a desired tension and pitch.

BACKGROUND OF THE INVENTION

A known type of tuning device of a stringed instrument is seen in U.S. Pat. No. 4,213,370 (Jones) where a peg and worm gear is affixed in a cavity formed by facing panels of a guitar body. The peg has a transverse and axial bore into which a string end is passed and a connecting portion of a string key connected to the peg through the worm gearing. U.S. Pat. No. 4,625,613 (Steinberger) shows a tuning unit including jaws which grasp a ball-headed string and is movable by an attached knob which tightens or loosens the string. U.S. Pat. No. 4,625,614 (Spercel) discloses another worm gear and key device with a string rotatable around the peg. It also shows a clamping pin for initially clamping a string end. U.S. Pat. Nos. 4,643,069 and 4,648,303 show other variants of a worm gear for winding a string around a rotatable peg.

The above tuning devices generally involve the imposition of frictional forces by use of lock washers or fastening screws so that the tuning knob resists needed rotational movement and becomes difficult to turn by hand, particularly making fine tuning adjustments for short increments of rotation difficult to precisely pitch tune the strings by hand. Oft times these devices require the need for an adjusting tool. Pinion and worm gear combinations do not normally result in more than about a 12 to 1 tuning ratio whereas it is preferable to have fine tuning ratios of the order of 40 to 1. The presence of worm gears and pinions also result in slippage or play commonly associated with worn worm tuning gear mechanisms.

SUMMARY OF THE INVENTION

The present invention provides a tuning device incorporating a direct screw drive mechanism in which the operative part of the mechanism includes an axial pretensioning and string clamping pin or screw and a coaxial string tensioning and fine tuning member. The device requires an extremely short distance of travel to bring a string to the proper pitch and eliminates the need for worm and pinion gears associated with most modern guitars and eliminates the need for a conventional string post as the means to anchor and rotate a string to the proper pitch. In so doing each of the strings of the instrument can be tuned in a longitudinal direction and does so with pitch screw adjustment screw ratios of the order of 40 to 1 resulting in fine tuning. These attributes are gained by a simple and compact arrangement with a minimum of assembly steps and connectors, all without the use of special tools to assembly or operate the devices. The direct drive of the invention results in a reduction of the effects of stress and fatigue as apparent with conventional capstan or other post tuning devices after repeated changes in string tension.

The present invention provides a tuning device having a threaded tuning rod and a corresponding threaded tuning knob which when rotated a short distance quickly tunes the string of a musical instrument to a desired pitch. The tuning rod includes a perpendicular passage through which the string is inserted and an axial passage which extends longitudinally through the tuning rod. A clamping assembly is concentrically disposed in the axial passage.

The string is inserted through the perpendicular passage and manually pulled taut to pretension the string. The clamping assembly is then engaged by turning a knob which moves a clamping pin in an axial passage to secure the string at pretensioned position. Alternatively a hex headed screw, with or without a pin, may be provided to clamp the string. This eliminates the need for additional string clamping mechanisms which are utilized to clamp the strings at the nut end of a musical instrument. These prior art clamping mechanisms are separated from the tuning mechanisms and serve to secure the strings after the strings have been tuned to pitch by the tuners. The opposite end of the string is secured to a pivoting bridge or tremolo device at the bridge end of the instrument. The mechanism of the present invention insures that the strings will return to their proper pitch after being detuned or detensioned by use of a tremolo device.

The string then may be tuned to the desired pitch by rotating the tuning knob which displaces the tuning rod (and the clamped string) longitudinally a short distance to tighten the string to the desired pitch from the initial pretensioned string position. A threaded tuning rod and a threaded tuning knob is the sole means of adjusting the tuning device. The string is tuned in a longitudinal direction through the displacement of the tuning rod by the tuning knob.

DETAILED DESCRIPTION

Figure 1:
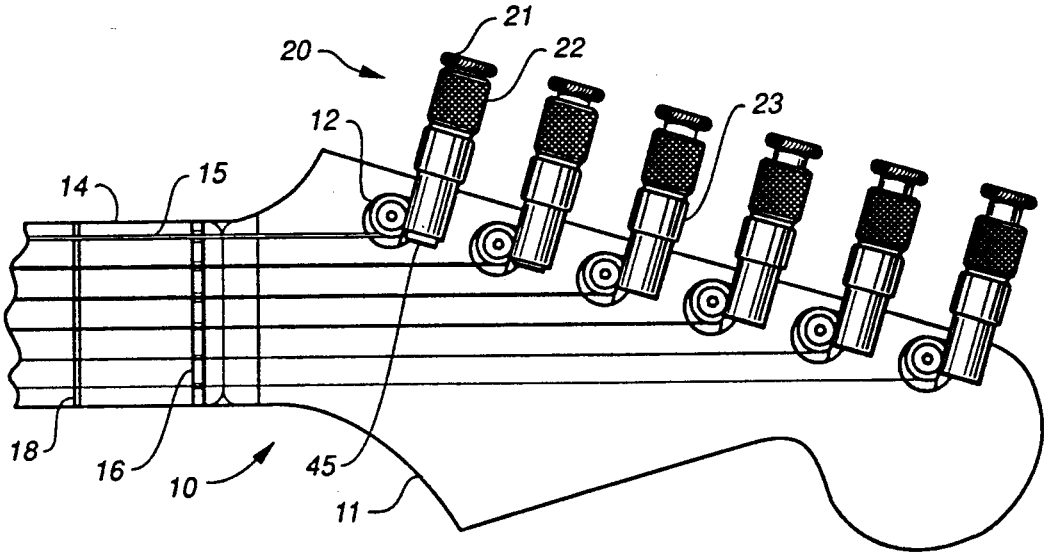
FIG. 1 is a top plan view of the apertured peg head of a guitar showing six mounted tuner devices.

A guitar 10 as shown in FIG. 1 has a conventional peg head end 11 having a series of normally aligned and width-wise offset apertures 12, normally six, of a fixed diameter, normally about 9.5 mm. A combined string mounting and string tuner device 20 is mounted in and oriented in aligned order in the peg head. The tuner device 20 essentially contains a tuner housing 23, tuner rod 45, a string clamp knob 21 and a tuner knob 22. A series of strings 15, normally six, extend over and above the guitar finger board 14 and frets 18, as in conventional constructions. Each of the strings of various diameters are clampable in the tuner housing and are tensioned by longitudinal movement of the tuner rod. Clamp knobs 21 are displaced over an increasing short distance form the tuning knobs 22 as the tuning rod is advanced longitudinally by the tuning knobs to tighten a string during the tuning procedure. This is illustrated by the various gaps between clamp knobs 21 and tuning knobs 22.

Figure 2:
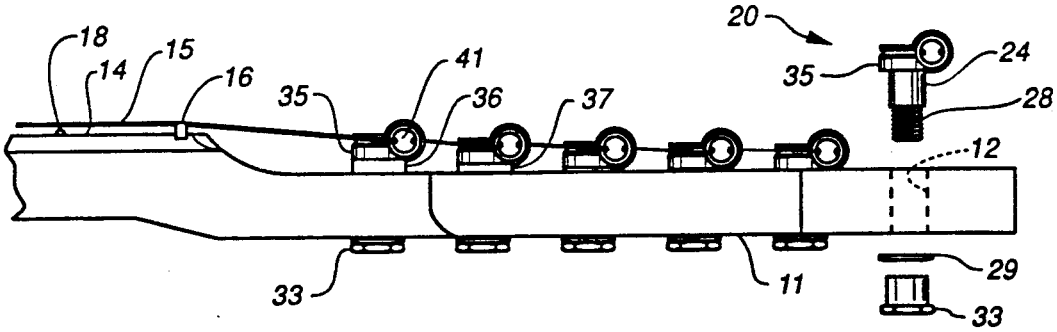
FIG. 2 is a side view thereof showing an exploded view of a tuner mounting.

FIG. 2 shows a tuner housing extension 24 which includes flange 35 and a threaded end or nipple 28 which is mountable in aperture 12. A suitable nut 33 threaded on end 28 with a standard washer 29 clamps the tuner device 20 in the peg head end 11. Each string is threaded into a transverse passageway 31 (FIG. 4) formed internally of the flat end 41 of tuner rod 45. A series of spacers 36, 37 of diminishing height from the finger board to the last aperture 12, illustrated with the exploded tuner which has no spacer, provides for proper vertical height of the tuner housing above the peg head in relation to the angle at which the string extends from the conventional grooved nut 16 which aligns the strings to the tuner.

Figures 3, 4:
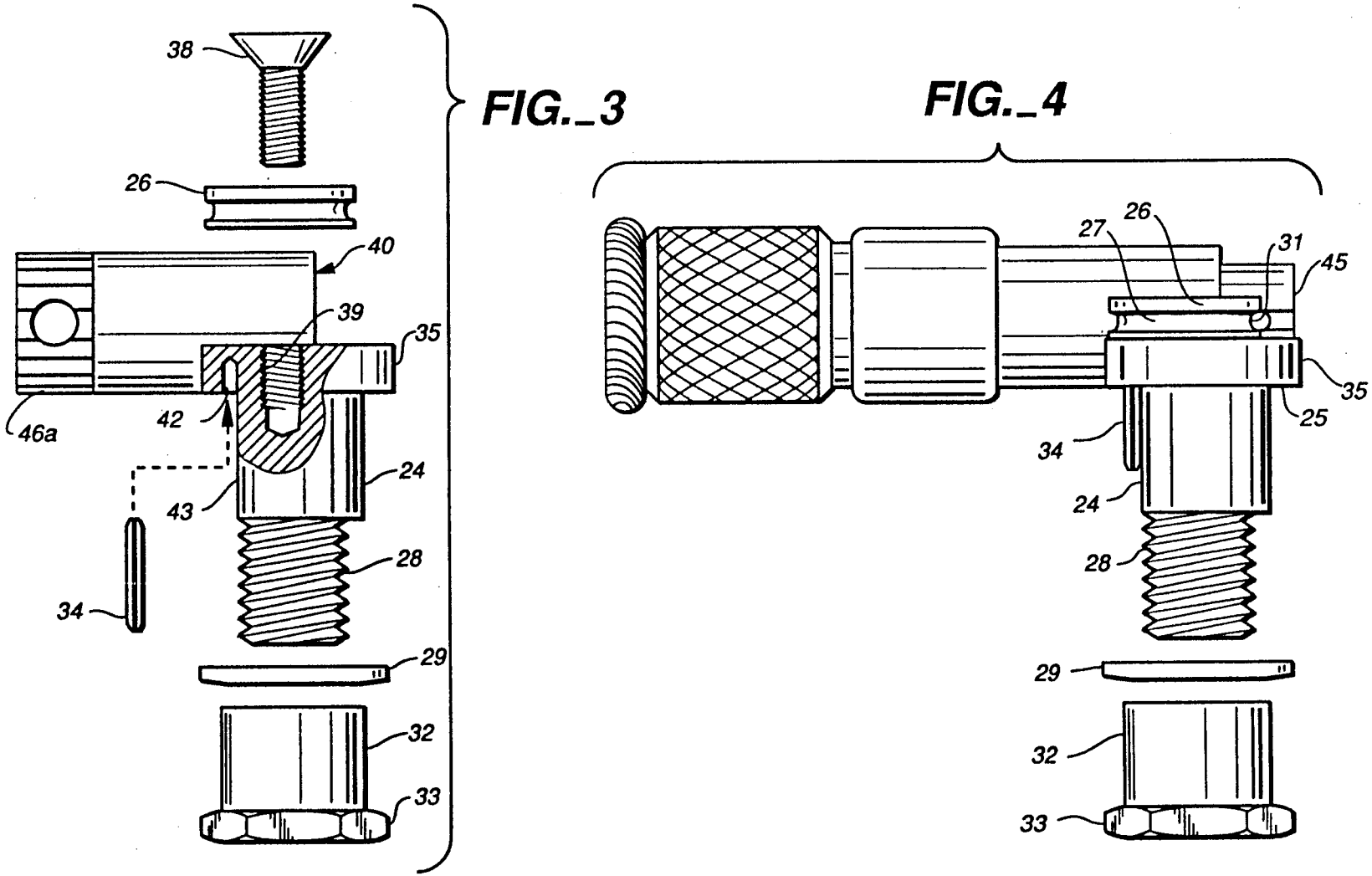
FIG. 3 is an exploded view of a tuner housing and its mounting hardware.
FIG. 4 is an exploded side view of the overall tuner device.

The tuner housing 40 is illustrated in FIG. 3 including the right angle mounting extension 24 with threaded end 28. An aperture 42 is provided on the underside edge of flange 35 for reception of an indexing roll pin 34 positionable along a flatted surface 43 on the extension 24. This properly orients the tuner device rotatively in aperture 12 so that each tuner device 20 is parallel to the its neighbor as shown in FIG. 1. A string guide 26 is mounted by screw 38 into a threaded aperture on the top side of integral flange 35. The housing 40 and extension 24 are preferably of a one-piece construction.

In the side view of FIG. 4 the edge of guide 26 contains a groove 27 in which a string (gut or wire) is passed into a transverse passageway 31 in the end of tuner rod 45. The bottom surface 25 of flange 35 when mounted on the peg end 11 abuts the top of the peg end. The smooth exterior 32 of nut 33 passes through washer 29 into each aperture 12 where it threadedly captures and clamps the tuner device 20.

Figure 5:
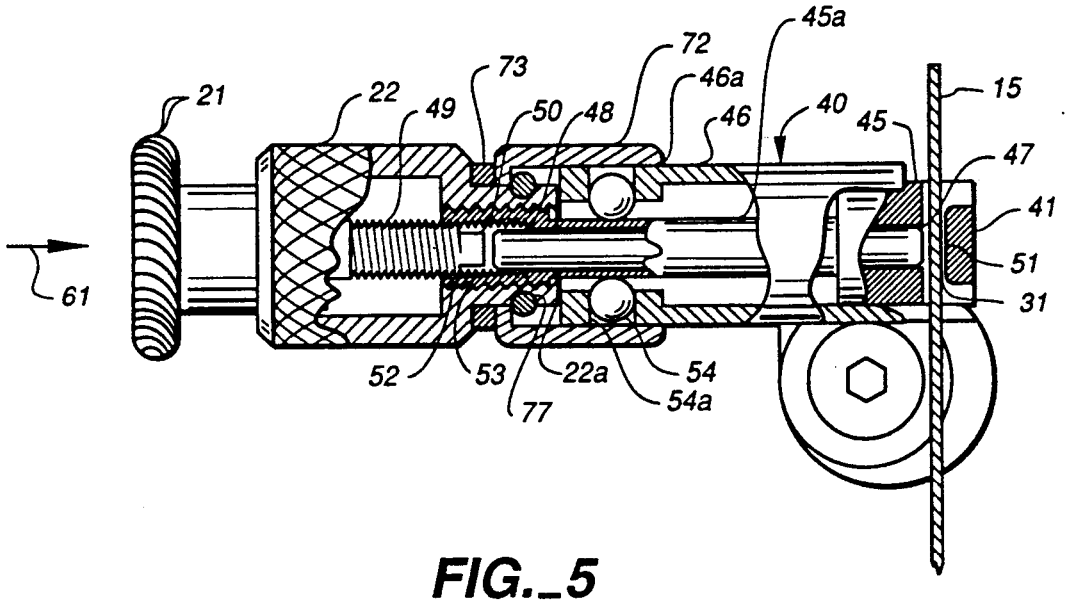
FIG. 5 is a cut-away plan view of the string clamping and string tuning mechanism showing initial string insertion.
Figure 6:
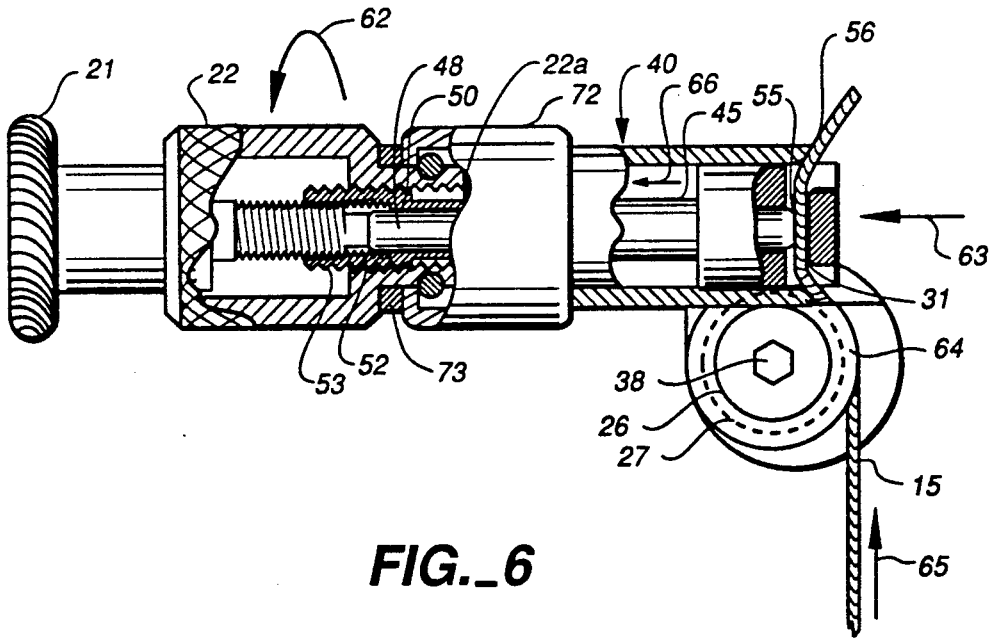
FIG. 6 is a cut-away cross-sectional view of the tuning device showing both the clamped and tensioned string.

The string clamping mechanism is shown in FIGS. 5 and 6. It comprises a clamping pin 48 and a thumb screw 21 both concentric to the tuning rod 45. The clamping pin is disposed concentrically in an internally threaded portion 53 of the tuning rod in which a threaded portion 49 of the thumb screw is engaged. At the opposite end of the tuning rod a perpendicular cylindrical passageway 31 provides a passage for a string. A concentric axial passage 47 through the length of the tuning rod extends to the perpendicular transverse string passageway 31. When a string is threaded through the perpendicular passageway in the tuning rod, the string is manually pulled taut. The thumb screw 21 is then manually rotated in a counterclockwise direction, an end 50 of which engages and moves the clamping pin 48 along the concentric passage, forcing the pin distal end 55 to engage the string against the inner sideway surface 51 of tuner rod end 41 and clamping the string tightly within the string passageway 31.

The tuning mechanism comprises the tuning rod 45, a knurled tuning knob 22, and a tuner housing. The tuner housing 40 is of one piece construction with a circular threaded base section 28 (FIG. 3) and a tubular section 46 in which the tuning rod is disposed. The tuning rod is slidably moved along the tubular section of the tuner housing. The tuning rod 45 is externally threaded at 53 at its outboard end and engages the tuner knob 22 internal threads 52. The tuner knob abuts the end of the tubular section of the tuner housing. The thread pitch is 10–40 on the outside threaded portion of the tuning rod, and engages the internally threaded tuning knob which has a corresponding 10–40 thread pitch.

When the tuner knob is manually rotated in a counter-clockwise direction (arrow 62), the tuning rod is threaded through the tuner knob, slidably advancing the tuning rod longitudinally and concentrically through the cylindrical inside surface of the tubular tuner housing 46. The string 15, which is fixedly engaged in the tuning rod by the clamping pin 48 is also slidably advanced longitudinally inwardly with the tuning rod as shown by arrows 63 and 66, as the tuning knob 22 is rotated, increasing the tension (arrow 65) of the string until the string is tensioned at the desired tuned pitch. A very short distance of longitudinal travel of the tuning rod is required to tension the string at the desired pitch. A curved end 56 of the tuner housing internal surface provides a smooth leading edge for the purpose of intentionally bending or deforming the string as the tuning rod advances longitudinally inwardly within the tuner housing., This allows the string to be deformed in a manner so that the string may slidably advance within the inner surface of the tubular tuner housing during the tuning procedure. Additionally, the internal end portion of the tubular housing is provided with a flattened through-hole (FIG. 9 and FIG. 5) which engages longitudinal exterior narrow flattened sections **45*a* of the tuning rod and the tuner housing simultaneously to hold the tuning rod from twisting or rotating within the tuner housing. In the FIG. 5 embodiment ball bearings 54 positioned in through holes 54*a* in tubular section 46** provide a bearing for the tuner rod longitudinal movement.

Figure 7:
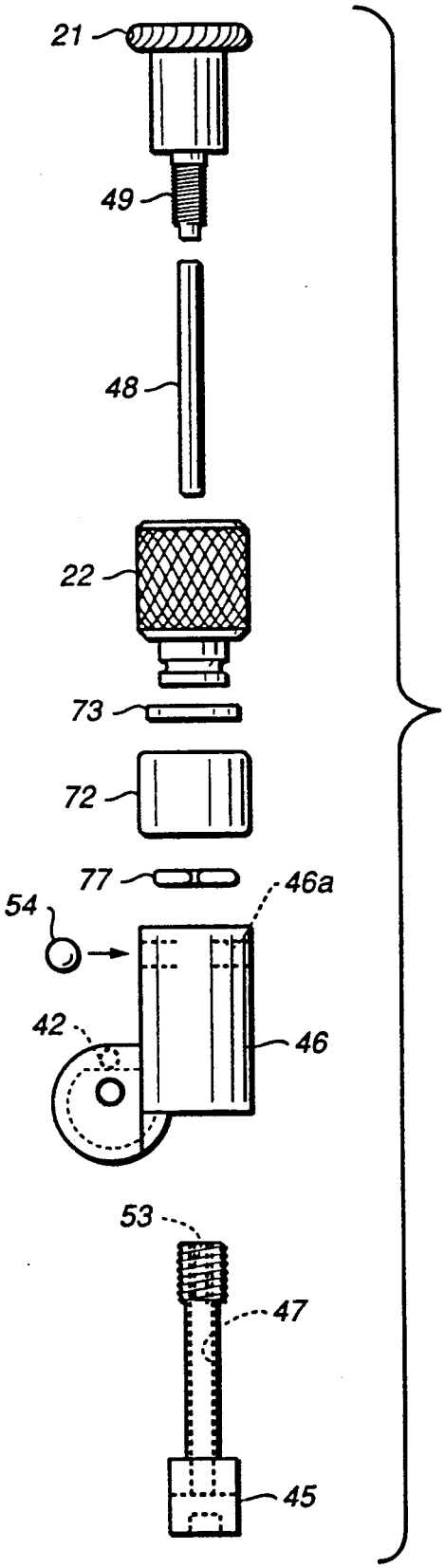
FIG. 7 is an exploded view showing the assembly of the lock knob, clamping pin, tuner knob and tuning rod into the tuner housing.

The tuning knob includes a circular end protrusion **22*a* inserted within a circular hole in a cylindrical retainer sleeve 72. The tuning knob also has a circular groove (FIG. 7) on the circular protrusion to accept a corresponding circular clip 77**.

The tuning knob is inserted into the circular hole in the sleeve against washer 73 and the circular clip is pressed into position in the circular groove on the tuning knob, engaging the tuning knob and the cylindrical sleeve. The tuning knob may rotate within the sleeve for the purpose of providing the bidirectional longitudinal movement of the threaded tuning rod, but the tuning knob is effectively captured within the cylindrical sleeve and is prevented from lateral or longitudinal movement.

The tuning knob and cylindrical retainer sleeve assembly are held in place on the tubular housing 46 by pressing the cylindrical retainer sleeve onto a corresponding external knurled longitudinally end section **46*a*** of the tubular housing in a press fit action, securing the cylindrical sleeve to the tuner housing.

The string guide disc 26 on the orthogonal side extension of the housing provides for proper alignment of the string to the tuning rod. As the tuner rod in a direction indicated by arrow 66 pulls on and tensions the string the loose part of string 15 positioned in groove 27 is easily pulled into passageway 31 and is guided therein by the grooved disc.

Figure 8:
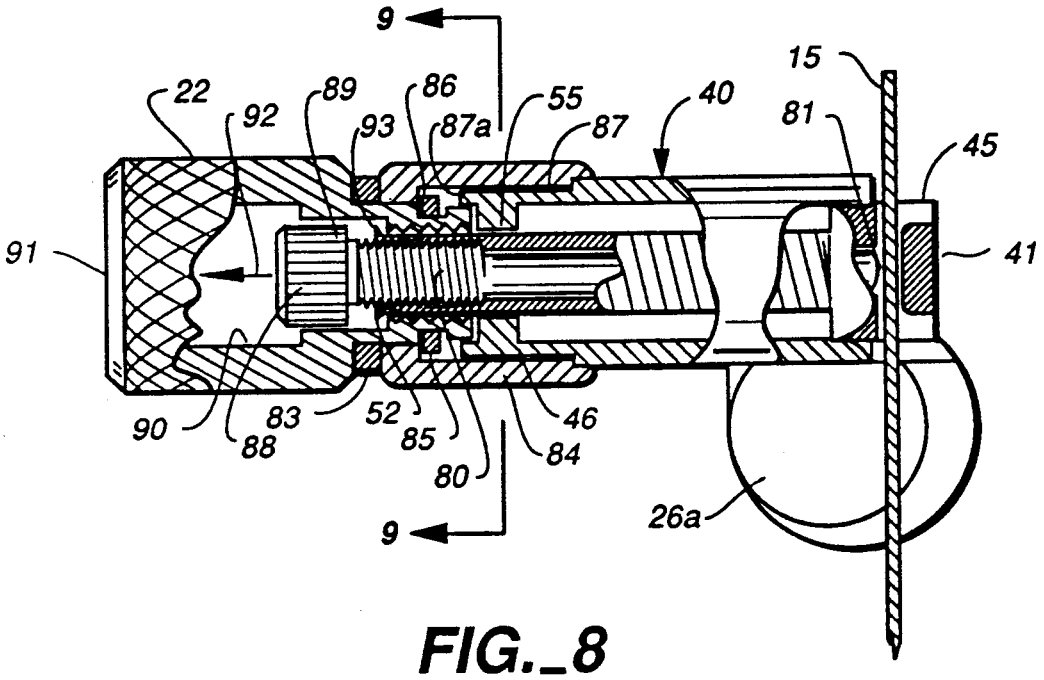
FIG. 8 is a cut-away plan view of a preferred embodiment of the string clamping and string tuning mechanism.

As alternative preferred string clamping arrangement is shown in FIG. 8, in which a one piece threaded hex-headed pin 80 is concentrically disposed in the axial passage of the tuning rod for the purpose of clamping a string 15. In this arrangement, a tool such as a hex-/Allen screw wrench is required to tighten the pin and pin end 81 against the string. This minimizes the height of the tuner mechanism and in effect, conceals the string locking feature.

This arrangement may also include a two-piece clamping assembly with a shortened clamping pin and a threaded screw in which the screw is tightened as in FIG. 8 against the separate pin with the use of a tool, and the pin engages and tightens against the string as in the FIG. 6 embodiment.

The FIG. 8 embodiment dispenses with the ball bearings of FIG. 5 by providing a first Teflon washer 83 between sleeve 84 and the underside of knob 22 and a second Teflon washer 85 press-fitted in a groove 86 in the knob lower portion. The sleeve 84 is press-fitted onto parallel longitudinal knurls 87*a* on a cylindrical recessed end 87 of the housing 40. The screw 80 includes a hex indentation i the top side 88 of the screw head 89. An Allen or hex wrench is inserted into the bore 90 through a top opening 91 in knob 22 into the hex indentation of screw 80 to rotate the screw so that it helically winds down to clamp string 15 at pin end 81 (as shown in FIG. 6) or turned oppositely to move the pin 80 upwardly (arrow 92) to unclamp the string. A flare 93 may be included on the proximal (outer) threaded top 95 of tuner rod 45 to prevent the tuning rod from dropping out when a string is not supporting the rod at its opposite distal end. FIG. 8 also illustrates an embodiment where the guide 26*a* is of a one-piece unitary construction with housing 40 dispensing with the need of a screw 38 in FIG. 3.

Figure 9:
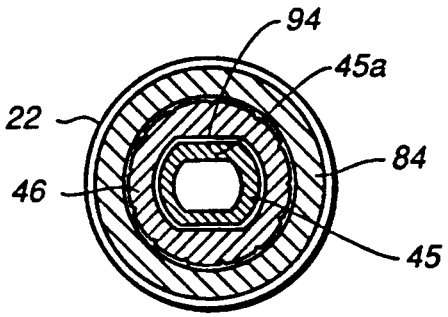
FIG. 9 is a cross-section of the mechanism (not including the clamp screw) taken on the line 9—9 of FIG. 8.

FIG. 9 is a cross-sectional view of the tubular housing showing a flattened through hole 94 which engages juxtaposed flattened sections 45*a* of the tuning rod.

The above description of the disclosed embodiments of this invention is intended to be illustrative and not limiting. Other embodiments of this invention will be apparent to those skilled in the art in view of the above disclosure.

I claim:

1. A stringed instrument tuning device wherein said instrument includes an apertured peg head, said device comprising:

a tuner housing having a tubular portion positionable exteriorly of a peg head aperture;

means extending from said tubular portion for positioning said device in an aperture of said peg head;

a cylindrical tuner rod extending within said housing tubular portion and having an externally threaded first end section;

string clamping means extending through said tuner rod first end section for clamping an instrument string in said housing adjacent a tuner rod second end section, said tuning rod second end section including a transverse passageway for reception of an end of said string; said clamping means having a distal end portion positioned to clamp said string end, and a lock means operably extending into a first end of said tuner housing for moving said distal end portion of said clamping means into a string clamping position; and a rotatable tuning knob exterior of said housing and threadably connected to said tuning rod threaded first end section, rotation of said tuning knob linearly advancing said tuning rod and said clamped string longitudinally and concentrically through said housing tubular portion to increase the tension in said string until the string is tensioned at a desired tuned pitch.

2. The tuning device of claim 1 wherein said lock means includes a lock knob and a clamping pin extending through a central aperture in said tuning knob.

3. The tuning device of claim 1 further including a string guide disc positioned exteriorly of and adjacent to said housing transverse passageway, for aligning an inserted string the said tuning rod.

4. The tuning device of claim 3 further including a spacer juxtaposed to said disc and having a length dictated by the angel at which the string extends from said tuning device to the remainder of the stringed instrument.

5. The tuning device of claim 4 wherein with respect to an aligned series of said tuning devices on a single instrument, the length of a spacer in each tuning device varies in length.

6. The tuning device of claim 1 wherein said lock means includes a lock screw recessed in said tuner knob.

7. The tuning device of claim 1 wherein said tuner housing includes an orthogonal offset portion extending from said housing tubular portion, said housing being of one-piece construction, and wherein said offset portion includes a threaded distal end positionable and connectable in an aperture in the apertured peg head.

8. The tuning device of claim 7 wherein said offset portion includes an exterior flat for keeping said offset portion in an indexed position in the peg head aperture.

9. The tuning device of claim 7 further including a string guide disc extending from said offset portion for guiding a string into said transverse passageway of said housing.

10. A stringed instrument tuning device wherein the instrument includes an apertured peg head, said device comprising:

a tuner housing having a first portion insertable into a peg head aperture, said housing having a second portion including a longitudinal passage;

a tuning rod translatably positioned in said passage, said rod including a distal end transverse passageway for reception of an end of a music string;

clamping means extending through a proximal end of said longitudinal passage for clamping the string end in said transverse passageway; and a tuning knob threadedly attached to said tuning rod adjacent to said passage proximal end to move said tuning rod and the clamped string longitudinally in said housing toward said proximal end of said longitudinal passage to tighten the string to a desired pitch.

11. The device of claim 10 wherein said clamping means includes a pin disposed concentrically within said tuning rod and wherein a thumb screw, concentric with said tuning knob, is rotatable to force said clamping pin into engagement with the string end and against a sidewall of said transverse passageway.

12. The device of claim 10 in which said tuner housing is of one-piece construction and said housing second portion including said tuning rod, said clamping means and said tuning knob, is adjacently positioned exteriorly of said apertured peg head and extends angularly from said apertured peg head.

13. The device of claim 10 further comprising means on said tuning rod for preventing rotation of said tuning rod in said tuner housing.

14. The device of claim 13 in which said means for preventing rotation comprises a flattened portion on said tuning rod and a juxtaposed flattened portion on said tuner housing.

15. The device of claim 10 further including a guide disc positioned adjacent to said tuning rod transverse passageway for aligning the string to said tuning rod.

16. The device of claim 10 including spacer means for adjusting the height of a tuning device in the peg head aperture as dictated by the angel at which the string extends from said tuning device to a finger board on the instrument.

17. The device of claim 10 in which said tuner housing first portion includes a cylindrical threaded nipple insertable into the peg head aperture and further including nut means for securing said nipple to the peg head aperture, and means for orienting said tuner housing at a predetermined angular position in the peg head aperture.

18. The device of claim 17 is which said means for orienting includes a flattened section adjacent to said threaded nipple for receipt of a roll pin.

19. The device of claim 10 in which said clamping means includes a screw having a screw head accessed through an open top of said tuning knob.

20. The device of claim 10 further including a retainer sleeve surrounding and affixed to said tuner housing, said sleeve retaining said tuning knob in rotative engagement with a threaded end of said tuner rod.

* * * * *